US009683781B2

(12) United States Patent
Byman

(10) Patent No.: US 9,683,781 B2
(45) Date of Patent: Jun. 20, 2017

(54) INDIRECT-HEAT THERMAL PROCESSING OF BULK SOLIDS

(71) Applicant: SOLEX THERMAL SCIENCE INC., Calgary (CA)

(72) Inventor: Ashley D. Byman, De Winton (CA)

(73) Assignee: Solex Thermal Science Inc., Calgary (CA)

( * ) Notice: Subject to any disclaimer, the term of this patent is extended or adjusted under 35 U.S.C. 154(b) by 8 days.

(21) Appl. No.: 14/825,709

(22) Filed: Aug. 13, 2015

(65) Prior Publication Data

US 2017/0045296 A1 Feb. 16, 2017

(51) Int. Cl.
*F28F 3/00* (2006.01)
*F27B 1/22* (2006.01)
(Continued)

(52) U.S. Cl.
CPC ..... *F27B 1/22* (2013.01); *F27B 1/10* (2013.01); *F27B 1/21* (2013.01); *F27B 1/28* (2013.01); *F27D 11/02* (2013.01); *F27D 21/00* (2013.01)

(58) Field of Classification Search
CPC .... F26B 17/12; F26B 3/14; F26B 3/26; F26B 3/04; F26B 3/06; F26B 13/18; F28D 9/0006; F28D 9/0031; F28D 9/0037; F28D 2020/0069; F28D 9/0081; F28F 3/12; F28F 3/005
(Continued)

(56) References Cited

U.S. PATENT DOCUMENTS 3,181,488 A * 5/1965 Roe ..... F23K 1/04 110/101 R
3,397,460 A * 8/1968 Hall ..... B01J 6/001 165/166
(Continued)

OTHER PUBLICATIONS

International Search Report and Written Opinion issued in corresponding International Application No. PCT/CA2015/050770.

*Primary Examiner* — Gregory A Wilson
(74) *Attorney, Agent, or Firm* — Geoffrey deKleine; Borden Ladner Gervais LLP

(57) ABSTRACT

An indirect-heat thermal processor for processing bulk solids includes a housing including an inlet for receiving the bulk solids and an outlet for discharging the bulk solids and a plurality of heat transfer plate assemblies disposed between the inlet and the outlet and arranged in spaced relationship for the flow of the bulk solids that flow from the inlet, between the heat transfer plate assemblies, to the outlet. The heat transfer plate assemblies include a heat spreader, a heating element disposed adjacent the heat spreader, a temperature detection device spaced from the heating element and disposed adjacent the heat spreader, covers disposed on opposing sides of the heat spreader, the heating element, and the temperature detection device to provide a sandwiched assembly in which the heat spreader, the heating element, and the temperature detection device are sandwiched between the covers, heating element couplings coupled to the heating element and extending from the sandwiched assembly for controlling the heating element, and a connector coupled to the temperature detection device and extending from the sandwiched assembly for monitoring a temperature at the temperature detection device.

22 Claims, 3 Drawing Sheets

(51) Int. Cl.

| | |
|---|---|
| ***F27B 1/10*** | (2006.01) |
| ***F27B 1/28*** | (2006.01) |
| ***F27B 1/21*** | (2006.01) |
| ***F27D 11/02*** | (2006.01) |
| ***F27D 21/00*** | (2006.01) |

(58) Field of Classification Search
USPC ..... 432/95, 79, 98, 100, 102; 34/165, 167, 34/168, 177; 165/104.15, 104.18, 165/164–168
See application file for complete search history.

(56) References Cited

U.S. PATENT DOCUMENTS

| | | | | |
|---|---|---|---|---|
| 4,784,216 | A | 11/1988 | Bracegirdle et al. | |
| 5,167,274 | A | 12/1992 | Mueller | |
| 6,328,099 | B1 * | 12/2001 | Hilt | C05G 3/0058 165/166 |
| 8,578,624 | B2 * | 11/2013 | Jordison | F26B 17/122 165/166 |
| 8,915,292 | B2 * | 12/2014 | Schatz | F28D 9/0031 165/157 |
| 9,459,054 | B2 * | 10/2016 | Huang | F28F 3/044 |
| 9,528,772 | B2 * | 12/2016 | Marold | B01D 5/0015 |
| 2013/0292093 | A1 | 11/2013 | Huang et al. | |

* cited by examiner

INDIRECT-HEAT THERMAL PROCESSING OF BULK SOLIDS

FIELD OF TECHNOLOGY

The present invention relates to a method and apparatus for indirect-heat thermal processing of bulk solids, such as a dryer, or heater for bulk solids.

BACKGROUND

Indirect-heat thermal processors such as heaters or dryers may utilize hot gases for heating or drying bulk solids as the bulk solids flow through the heater or dyer. The use of hot air is inefficient as large volumes of hot air are utilized and waste heat in the exhaust air is difficult to recover.

Heat transfer plates or tubes provide improved efficiency in heat exchangers by indirectly heating bulk solids that flow, under the force of gravity, through a heat exchanger. The heat transfer plates or tubes include a heating fluid flowing through the plates or tubes and the bulk solids are heated as they flow through spaces between adjacent heat transfer plates. Such heat transfer plates and systems for heat transfer plates and tubes require a complex construction and control to maintain the temperature of the heating fluid at a desirable temperature for treatment of the bulk solids flowing between the heat transfer plates.

Improvements in indirect-heat thermal processors are desirable.

SUMMARY

According to one aspect of an embodiment, an indirect-heat thermal processor is provided for processing bulk solids. The indirect-heat thermal processor includes a housing including an inlet for receiving the bulk solids and an outlet for discharging the bulk solids and a plurality of heat transfer plate assemblies disposed between the inlet and the outlet and arranged in spaced relationship for the flow of the bulk solids that flow from the inlet, between the heat transfer plate assemblies, to the outlet. The heat transfer plate assemblies include a heat spreader, a heating element disposed adjacent the heat spreader, a temperature detection device spaced from the heating element and disposed adjacent the heat spreader, covers disposed on opposing sides of the heat spreader, the heating element, and the temperature detection device to provide a sandwiched assembly in which the heat spreader, the heating element, and the temperature detection device are sandwiched between the covers. Heating element couplings are coupled to the heating element and extend from the sandwiched assembly for controlling the heating element. A connector is coupled to the temperature detection device and extends from the sandwiched assembly for monitoring a temperature at the temperature detection device.

According to another aspect of an embodiment, a heat transfer plate assembly for use in an indirect-heat thermal processor for processing bulk solids is provided. The heat transfer plate assembly includes a heat spreader, a heating element disposed adjacent the heat spreader, a temperature detection device spaced from the heating element and disposed adjacent the heat spreader, covers disposed on opposing sides of the heat spreader, the heating element, and the temperature detection device to provide a sandwiched assembly in which the heat spreader, the heating element, and the temperature detection device are sandwiched between the covers. Heating element couplings are coupled to the heating element and extend from the sandwiched assembly for controlling the heating element. A connector is coupled to the temperature detection device and extends from the sandwiched assembly for monitoring a temperature at the temperature detection device.

The heating element may be recessed in a first channel in the heat spreader and the temperature detection device is recessed in a second channel in the heat spreader.

A plurality of temperature detection devices may be utilized, including the temperature detection device. The plurality of temperature detection devices are spaced apart along the heat spreader.

Edges of the sandwiched assembly may be sealed to inhibit ingress of fluid, including liquids and gases, into the heat transfer plate assemblies. The edges may be sealed, for example, by welding edges of the covers.

A stiffening bar or stiffening bars may extend along an edge or edges of the sandwiched assembly.

BRIEF DESCRIPTION OF THE DRAWINGS

Embodiments of the present disclosure will now be described, by way of example only, with reference to the attached figures, in which.

DETAILED DESCRIPTION

Figure 1:
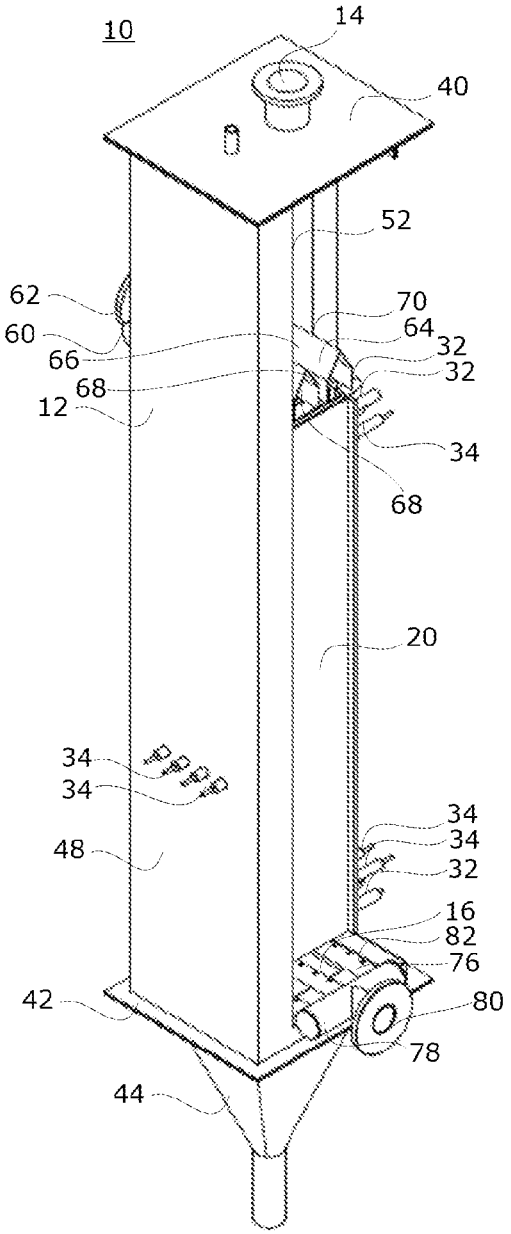
FIG. 1 is a three-dimensional view of an indirect-heat thermal processor with part of a front and a side removed for the purpose of illustration.

The following describes a heat transfer plate and an indirect-heat thermal processor that utilizes the heat transfer plate. For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

As illustrated in the figures, the indirect-heat thermal processor 10 includes a housing 12 including an inlet 14 for receiving the bulk solids, an outlet 16 for discharging the bulk solids, and a plurality of heat transfer plate assemblies 20 disposed between the inlet 14 and the outlet 16 and arranged in spaced relationship for the flow of the bulk solids that flow from the inlet 14, between the heat transfer plate assemblies 20, to the outlet 16. The heat transfer plate assemblies 20 include a heat spreader, 22 a heating element 24 disposed adjacent the heat spreader 22, a temperature detection device 26 spaced from the heating element 24 and disposed adjacent the heat spreader 22. The heat transfer plate assembly 20 also includes covers 28 disposed on opposite sides of the heat spreader, 22 the heating element 24, and the temperature detection device 26 to provide a sandwiched assembly 30 in which the heat spreader 22, the heating element 24, and the temperature detection device 26 are sandwiched between the covers 28. Heating element couplings 32 are coupled to the heating element 24 and extend from the sandwiched assembly 30 for controlling the heating element 24. A connector 34 is coupled to the temperature detection device 26 and extends from the sandwiched assembly 30 for monitoring a temperature at the temperature detection device 26.

Figure 2:
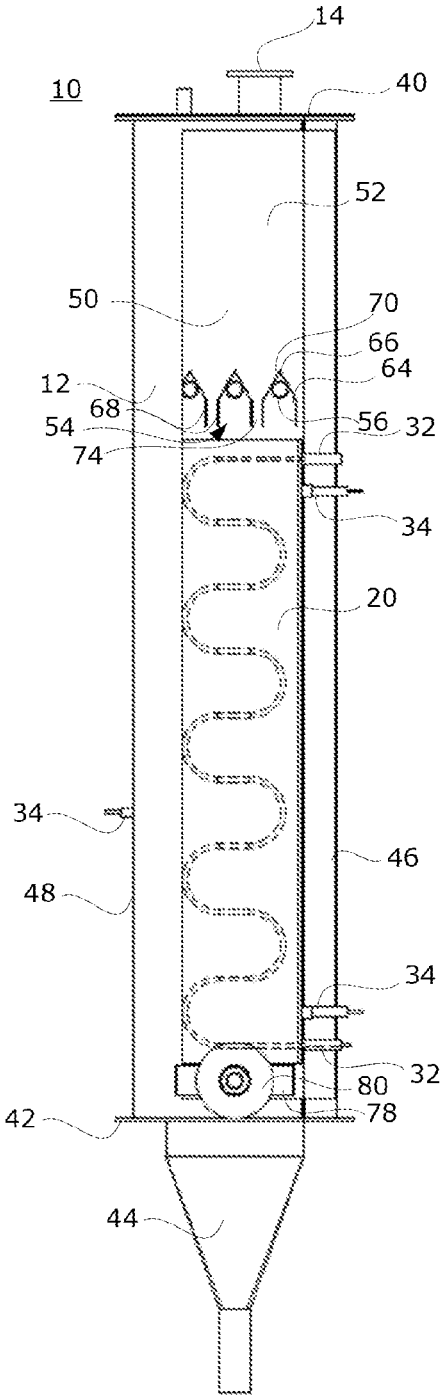
FIG. 2 is a side view, of the indirect-heat thermal processor of FIG. 1 with a side removed for the purpose of illustration.
Figure 3:
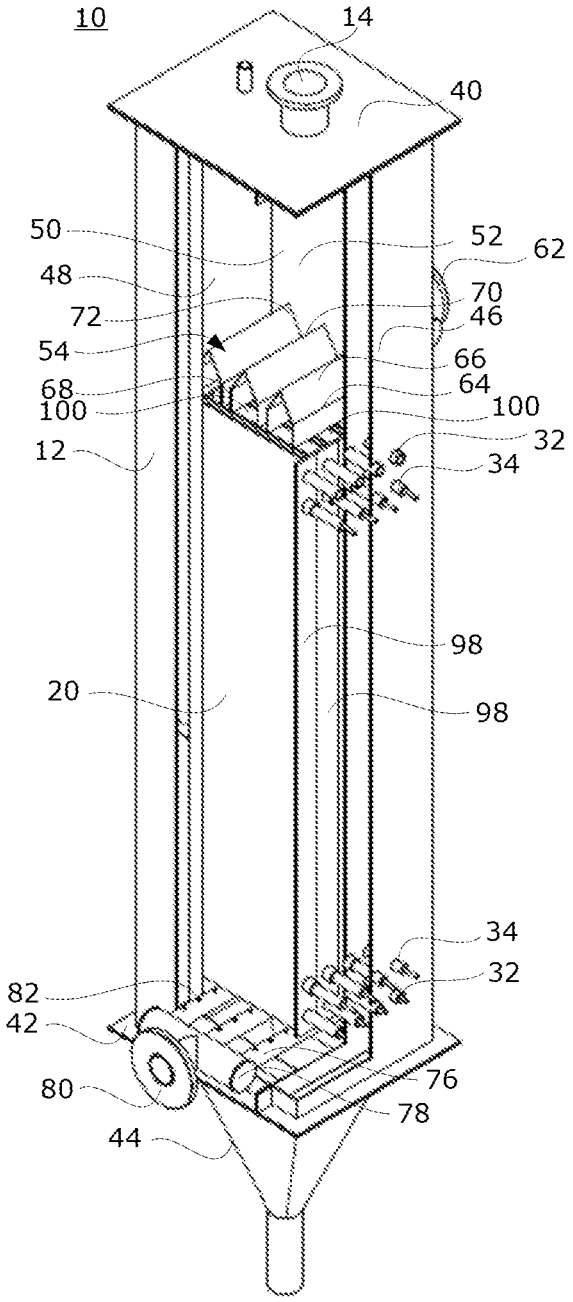
FIG. 3 is an alternative three-dimensional view of the indirect-heat thermal processor of FIG. 1 with part of a front and a side removed for the purpose of illustration.

Views of an indirect-heat thermal processor 10 with parts of a front and a side removed for the purpose of illustration is shown in FIG. 1, FIG. 2, and FIG. 3. The housing 12 of the heat exchanger 10 has a generally rectangular cross-section and includes a top 40 and a bottom 42. The top 40 of the housing 12 includes the inlet 14 for introducing bulk solids into the indirect-heat thermal processor 10. The bottom 42 of the housing 12 is open to provide the outlet 16 for discharging bulk solids from the housing 12 to an optional discharge hopper 44, and out of the indirect-heat thermal processor 10. A plurality of heat transfer plate assemblies 20 are disposed within the housing 12, between the inlet 14 and the outlet 16. The heat transfer plate assemblies 20 are spaced apart and arranged generally parallel to each other in a row, also referred to as a bank. In the example shown in FIG. 1, the indirect-heat thermal processor 10 includes four heat transfer plate assemblies 20 that are arranged in a single bank. Other suitable numbers of heat transfer plate assemblies 20 may be included in the bank and more than one bank may be included in the housing 10. For example, 2 or more banks may be included and may be stacked vertically in the housing 12.

The housing 12 includes a front 46 and a back 48 and opposing sides 50. The front 46, back 48, and sides 50 of the housing 12 may be sealed, for example, by seam welding along the sides to generally seal the front 46, the back 48, and the sides of 50 of the housing 12. The top 40, the bottom 42, and the discharge hopper 44 may also be sealed, for example, by welding the top 40 to the top edges of the front 46, the back 48, and the sides 50, welding the bottom 42 to the bottom edges of the front 46, the back 48, and the sides 50, and welding the discharge hopper 44 to the bottom 42. Thus, the housing 12 may be generally sealed, for example, for heat exchange in an inert gas environment within the housing 12 or the use of a sweep or purge gas through the housing 12.

The heat transfer plate assemblies 20 are sufficiently spaced from the inlet 14 to provide a hopper 52 in the housing 12, between the inlet 14 and the top of the heat transfer plate assemblies 20 and to accommodate a gas outlet plenum 54. The hopper 52 facilitates distribution of bulk solids that flow from the inlet 14, as a result of the force of gravity, over the heat transfer plate assemblies 20.

The gas outlet plenum 54 includes a plurality of gas outlets that, in the present example, comprise openings 56 in one of the sides 50 of the housing. Alternatively, air openings may be included in both sides 50 of the housing. Gas transfer pipes (not shown) are coupled to the side 50 of the housing 12, at the openings 56 such that the gas transfer pipes extend outwardly, away from the housing 12, for gas flow from the housing 12 and into the gas transfer pipes. The gas transfer pipes may be welded to the side 50 to form a seal with the housing 12.

In this example, the gas transfer pipes are coupled to a manifold 60, which is coupled to a flange 62 for coupling to an exhaust tube or pipe to facilitate gas flow from the housing, through the gas transfer pipes, through the manifold 60 and into the exhaust tube or pipe. The gas transfer pipes, the manifold 60, and the flange 62 are disposed outside the housing and may be sealed, for example, by welding to inhibit leakage of gas outside the housing 12.

A respective deflector 64 is associated with each of the openings 56. The deflectors 64 each include a wedge-shaped upper portion 66 and generally parallel sides 68 extending downwardly from the wedge-shaped upper portion 66. The apex 70 of the wedge-shaped upper portion 66 is disposed at the upper-most portion of the deflector 64 and the generally parallel sides 68 extend generally downwardly from the two spaced-apart ends of the wedge-shaped upper portion 66.

Each deflector 64 extends across the interior of the housing 12, from one of the sides 50 to the opposing side 50 of the housing 12, and is coupled to the housing 12 by, for example, welding the edges 72 of the deflector 64 to the sides 50 of the housing 12. The respective associated opening 56 is located in the sidewall 50 of the housing, near the apex 70 of the wedge-shaped upper portion 66 of the deflector 64. The deflectors 64 are spaced apart to form a slot 74 between the generally parallel sides 68 of adjacent deflectors 64.

The deflectors 64 facilitate deflection of the bulk solids from the hopper 52, through the slots 74, and into the spaces between the heat transfer plate assemblies 20. When in use, the deflectors 64 provide a free space between the bulk solids and each opening 56 to inhibit the passage of bulk solids into the openings 56.

In the present example, three deflectors 64 and three openings 56 are shown. The indirect-heat thermal processor 10, however, may have any suitable number of deflectors associated with any suitable number of openings.

The heat transfer plate assemblies 20 are also sufficiently spaced from the outlet 16 to accommodate gas inlet pipes 76 disposed between the heat transfer plate assemblies 20 and the outlet 16, and to facilitate the flow of bulk solids through the outlet 16. The discharge hopper 44 may be utilized at the outlet 16 to create a mass flow or "choked flow" of bulk solids and to regulate the flow rate of the bulk solids through the indirect-heat thermal processor. An example of a discharge hopper 44 is described in U.S. Pat. No. 5,167,274, the entire content of which is incorporated herein by reference. The term "choked flow" is utilized herein to refer to a flow other than a free fall of the bulk solids as a result of the force of gravity.

Each of the gas inlet pipes 76 is closed on one end and is coupled to gas inlet manifold 78 on the opposing end. The gas inlet manifold 78 is coupled to a gas inlet flange 80 for coupling a gas source thereto. The gas inlet pipes 76, gas manifold 78, and gas inlet flange 80 may be sealed, for example, by welding the gas inlet pipes 76 to the gas inlet manifold 78 and welding the gas inlet manifold 78 to the gas inlet flange 80 to form the seal and couple the parts.

The gas inlet pipes 76 in the present example extend the full width of the housing 12 from one of the sides 50 to the opposing side 50. The closed ends of the gas inlet pipes 76 may be closed, for example, by welding the gas inlet pipes 76 to the side 50. The opposing ends of the gas inlet pipes 76 extend through the opposing side of the housing 12 and are coupled to the gas inlet manifold 78 outside the housing 12. Thus, the gas inlet manifold 78 and the gas inlet flange 80 are disposed outside the housing 12.

The gas inlet pipes 76 include apertures 82 along the length thereof to facilitate gas flow into the housing and to distribute gas flow across the length of the gas inlet pipes 76. In the present example, three gas inlet pipes 76 are illustrated. Any other suitable number of gas inlet pipes may be utilized and more than one gas inlet manifold may be utilized.

Figure 4:
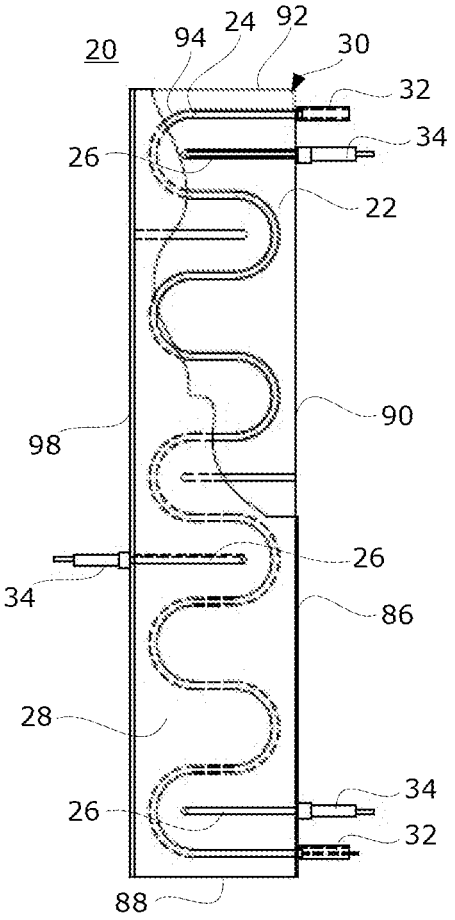
FIG. 4 is a three-dimensional view, partly cut away, of a heat transfer plate assembly of the indirect-heat thermal processor of FIG. 1.
Figure 5:
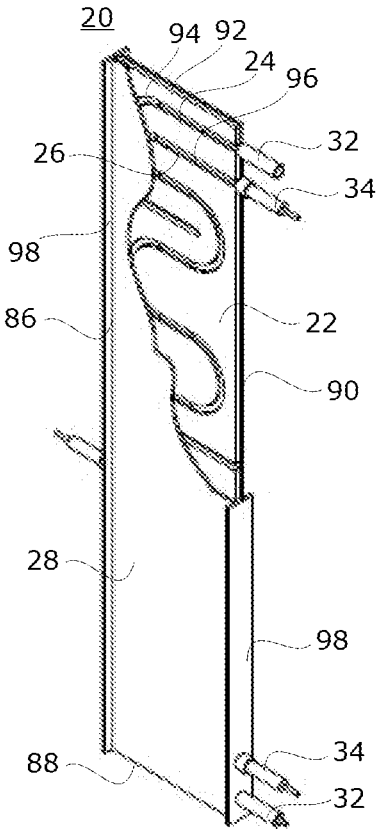
FIG. 5 is a side view, partly cut away and showing hidden detail, of a heat transfer plate assembly of the indirect-heat thermal processor of FIG. 1.
Figure 6:
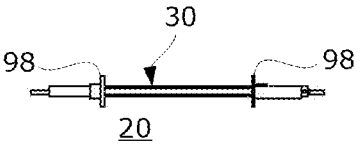
FIG. 6 is a top view of the heat transfer plate assembly of FIG. 1.

Views of an example of a heat transfer plate assembly 20 of the indirect-heat thermal processor are shown in FIG. 4, FIG. 5, and FIG. 6. The heat transfer plate assembly 20 includes the covers 28, which are metal sheets of, for example, stainless steel, such as 316L stainless steel. The covers 28 sandwich the heat spreader 22, the heating element 24 and the temperature detection device 26 to provide the sandwiched assembly 30.

The sandwiched assembly 30 in the present example is generally rectangular in shape and includes opposing long edges 90 and opposing short edges 92. When assembled in the housing 12 of the indirect-heat thermal processor 10, the long edges 90 generally extend vertically in the housing 12 and the short edges 92 are generally parallel with the top 40 and bottom 42 of the housing. Alternatively, the sandwiched assembly 30 may be generally square or may have opposing short edges that extend generally vertically in the housing 12, when assembled in the housing, and opposing long edges that extend generally parallel with the top 40 and the bottom 42. Thus, the sandwiched assembly may be any suitable size.

The heat spreader 22 is a generally solid metal plate heat spreader of, for example, copper, that extends generally the length and height of the sandwiched assembly 30 to spread the heat from the heating element 24. Thus, in the present example, the heat spreader 22 includes opposing long edges 86 that generally correspond with the long edges 90 of the sandwiched assembly 30 and opposing short edges 88 that generally correspond with the short edges 92 of the sandwiched assembly 30.

The heat spreader 22 is constructed, for example by milling the solid metal plate to include channels 94, 96 therein, in which the heating element 24 and the temperature detection devices 26 are recessed. The heat spreader 22 has a thickness that is generally equal to the diameter or thickness of the heating element 24. Thus, the heating element channel 94 in the heat spreader 22 in the present example, cuts the heat spreader into two parts with a respective part on each side of the heating element 24. The heating element channel 94 in the heat spreader 22 is sized to tightly fit the heating element 24 and reduce the chance of formation or size of any air pocket between the heating element 24 and the heat spreader 22. Thus, the heating element channel 94 is generally equivalent in size to the size of the heating element 24. The temperature detector channels 96 are larger than the temperature detection devices 26 to facilitate removal and replacement of the temperature detection devices 26.

The heating element channel 94 begins at a long edge 86 of the heat spreader 22, near a short edge 88 and ends at the same long edge 86 of the heat spreader 22, near the opposing short edge 88, and is generally serpentine-shaped between the start and end of the heating element channel 94. In the present example, the heat spreader 22 includes five temperature detector channels 96 to receive three temperature detection devices 26 therein that are spaced apart from each other along the heat spreader 22 to detect the temperature at various locations along the heat spreader 22. Each temperature detector channel 96 extends from a long edge 86 of the heat spreader 22, generally linearly into the heat spreader 22. The temperature detector channels 96 are spaced from and do not cross over the heating element channel 94 to maintain a space between the heating element 24 and the temperature detection devices 26. In the present example, five temperature detector channels 96 are included in the heat spreader 22, including three that extend in from one long edge 86 and two that extends in from the opposing long edge 86.

The heating element 24 may be, for example, a resistance heating element such as a MIQ™ mineral insulated cable or heat tracing cable, with a thin stainless steel sheath, such as stainless steel alloy 825. The heating element 24 extends through the serpentine-shaped heating element channel 94 to generally heat the heat spreader 22 throughout the length and height thereof. Because the heating element 24 is about the size of the serpentine-shaped heating element channel 94, the heating element 24 does not protrude from the side of the heat spreader 22 when inserted into the serpentine-shaped heating element channel 94.

The spacing between the passes of the serpentine heating element channel 94 and heating element 24 may be equal as illustrated in the present example, alternatively, the spacing may vary. For example, the spacing between passes of the serpentine heating element channel 94 and heating element may be larger near a top edge of the heat transfer plate assembly 20 than near a bottom edge of the heat transfer plate assembly 20, when the heat transfer plate assembly 20 is assembled in the housing 12.

The covers 28 of the heat transfer plate assembly 20 are coupled at various locations to the heat spreader 22. For example, the covers 28 may be coupled to the heat spreader 22 by rivets that extend through the covers 28 and the heat spreader 22 and the rivets may be welded to the covers 28 to seal the rivet holes in the covers 28. Such rivets are located at locations such that the rivets extend through the covers 28 and heat spreader 22 and do not extend through or interrupt the heating element 24 or the temperature detection devices 26. Alternatively, the covers 28 and heat spreader 22 may be plug welded at various locations or otherwise bonded.

Optionally, a heat transfer paste may be utilized to facilitate heat transfer. The heat transfer paste may be disposed between each cover 28 and the heat spreader 22. A heat transfer paste may also be utilized between the heating element 24 and the heat spreader 22 and between the heating element 24 and one or both of the covers 28.

Optionally, an insulating material may be utilized between the heating element 24 and one or both of the covers 28 to reduce heat transfer between the heating element 24 and the covers 28 to facilitate even heating and reduce the formation of hot spots along the covers.

In the embodiment described herein with reference to the figures, each heat transfer plate assembly 20 includes only a single heating element. Alternatively, the heat transfer plate assembly 20 may include more than one heating element. The heat spreader 22 may also include more than one heating element channel to accommodate more than one heating element. With additional heating elements, additional heating element couplings are utilized to electrically couple to the heating elements. Thus, where more than one heating element is utilized, the heating elements may be separately controlled to operate at different power levels or temperatures, or both.

The temperature detection devices 26 in the present example are resistance temperature detectors (RTDs) that are utilized to identify the temperature at the locations of the temperature detection devices 26 by measuring resistance in each device and correlating each resistance to temperature. As with the heating element 24, the temperature detection devices 26 are recessed in the heat spreader 22 such that the temperature detection devices 26 do not protrude from the sides of the heat spreader 22.

Optionally, one or more of the temperature detection devices 26 may extend further into the heat spreader 22 such that the tip of the temperature detection device 26 is disposed very near the heating element 24 to provide a better measurement of the actual temperature of the heating element 24.

The heat transfer plate assemblies 20 also include metal stiffening bars 98 that extend along the long edges 90 of the sandwiched assembly 30 to provide strength and stiffness to the sandwiched assembly 30. The metal stiffening bars 98 are welded to both the covers 28, along the length of the covers 28 to generally seal the long edges 90 of the sandwiched assembly 30. The short edges 92 of the sandwiched assembly are also welded along the length thereof, for example, by welding the short edges 88 of the covers 28 together. By welding along the long edges 86 and along the short edges 88, the heat transfer plate assembly 20 is generally sealed to inhibit ingress of fluid, which includes gases and liquids, into the heat transfer plate assembly 20 when in use in the indirect heat thermal processor 10.

The metal stiffening bars 98 have a width that is greater than the thickness of the sandwiched assembly 30 such that the metal stiffening bars 98 and the sandwiched assembly 30 together are generally in the shape of an I-beam, or beam having a generally I-shaped cross-section.

The heating element couplings 32 are coupled to the heating element 24 and extend outwardly, away from the long edge 90 of the sandwiched assembly 30 and through the associated one of the metal stiffening bars 98 for electrical connection to the heating element 24 to facilitate control of and heating utilizing the heating element 24.

A respective connector 34 is coupled to each of the temperature detection devices 26 and extends from the sandwiched assembly 30 and through the associated metal stiffening bar 98 for electrical connection to the temperature detection devices 26 to facilitate monitoring the temperature at the temperature detection devices 26.

When assembled in the indirect-heat thermal processor 10, the heat transfer plate assemblies 20 are secured in the housing 12 such that the long edges 90 of each sandwiched assembly 30 are generally vertically disposed in the indirect-heat thermal processor 10. The sandwiched assembly 30 of each heat transfer plate assembly 20 is generally parallel to the sides 50 of the housing 12 and the metal stiffening bars 98 are generally parallel to the front 46 and back 48 of the housing 12. The heat transfer plate assemblies 20 are secured in the housing 12 by welding the connectors 34 and the heating element couplings 32 to the front 46 of the housing and to the back 48 of the housing 12.

The metal stiffening bars 98 abut the front 46 and the back 48 of the housing 12 such that the heat transfer plate assemblies 20 generally extend the entire distance from the front 46 to the back of the housing 12. The metal stiffening bars 98 extend laterally outwardly from the sandwiched assembly 30 to provide spacers, thereby spacing the sandwiched assemblies 30 of adjacent heat transfer plate assemblies 20 apart and providing an even spacing between the sandwiched assemblies 30. Thus, the heat transfer plate assemblies 20 are arranged in spaced relationship to facilitate the flow of bulk solids between adjacent heat transfer plate assemblies 20.

The heating element couplings 32 extend through apertures in the front 46 of the housing 12 for electrical connection to the heating element 24. The connectors 34 extend through apertures in the front 46 and the back 48 of the housing 12 such that each connector 34 extends through either the front 46 or the back 48 for electrical connection to the temperature detection devices 26. The housing 12 may be sealed around the heating element couplings 32 and the connectors 34 to generally seal the housing 12.

In use, the heating elements 24 in the heat transfer plate assemblies 20 are controlled to control the temperature in the heat spreaders 22 utilizing the temperature detection devices 26. The heating elements may be individually controlled to facilitate even heating throughout the housing 12.

The operation of the heat exchanger 10 will now be described with reference to FIG. 1 to FIG. 4. When bulk solids are fed into the housing 12, through the inlet 14, the bulk solids flow downwardly as a result of the force of gravity, from the inlet 14, into the hopper 52. The hopper 52 facilitates distribution of the bulk solids. The bulk solids flow through the slots 74 between the deflectors 64 and into the passageways 100 between adjacent heat transfer plate assemblies 20. The bulk solids flow through passageways 100 between adjacent heat transfer plate assemblies 20, to the outlet 16. Bulk solids that contact upper edges of the heat transfer plate assemblies 20 are deflected into the passageways 100.

As the bulk solids flow between adjacent heat transfer plate assemblies 20, through the passageways 100, the bulk solids are heated as a result of heat transfer from the heat transfer plate assemblies 20 to the bulk solids. Thus, the heat transfer plate assemblies 20 are electrically heated to indirectly heat the bulk solids. The heated bulk solids flow from the passageways 100, through the outlet 16 and into the discharge hopper 44, where the bulk solids are discharged under a "choked" flow.

By controlling the heating elements 24 based on the temperature detected utilizing the temperature detection devices 26, and controlling the residence time in the indirect-heat thermal processor 10 by controlling the "choked" flow, the heating of the bulk solids is controlled.

Optionally, the heating may be carried out in an inert atmosphere inside the indirect-heat thermal processor 10. Alternatively, the heating may be carried out in the presence of a sweep or purge gas, such as argon or nitrogen, that flows through the housing 12. For example, a sweep gas may be introduced through the gas inlet manifold 78, the gas inlet pipes 76, through the apertures 82 and into the housing 12. The gas flows generally upwardly, countercurrent to the flow of the bulk solids, and exits through the openings. The purge or sweep gas advantageously flows through the bulk solids as the bulk solids are heated and gaseous emissions generated during heating are removed. Gaseous emissions may be generated during drying or during removal of chemicals such as volatile organic compounds, depending on the use of the indirect-heat thermal processor 10 and the bulk solids treated.

Advantageously, the heat transfer plate assemblies may be controlled together or may each be controlled separately. In addition, different banks of heat transfer plate assemblies may be controlled separately, for example, to have plates in banks that are at different temperature, to thereby increase the temperature of the plates as the bulk solids flow downwardly in the housing 12. The heat transfer plate assemblies are controlled without the use of heating fluid that may require specialized equipment for handling and may be heated to relatively high temperatures.

The scope of the claims should not be limited by the preferred embodiments set forth in the examples, but should be given the broadest interpretation consistent with the description as a whole.

What is claimed is:

1. An indirect-heat thermal processor for processing bulk solids, the indirect-heat thermal processor comprising:

a housing including an inlet for receiving the bulk solids and an outlet for discharging the bulk solids;

a plurality of heat transfer plate assemblies disposed between the inlet and the outlet and arranged in spaced relationship for the flow of the bulk solids that flow from the inlet, between the heat transfer plate assemblies, to the outlet;

ones of the heat transfer plate assemblies including:

a heat spreader;

a heating element disposed adjacent the heat spreader;

a temperature detection device spaced from the heating element and disposed adjacent the heat spreader;

covers disposed on opposing sides of the heat spreader, the heating element, and the temperature detection device to provide a sandwiched assembly in which the heat spreader, the heating element, and the temperature detection device are sandwiched between the covers;

a heating element coupling coupled to the heating element and extending from the sandwiched assembly for controlling the heating element; and a connector coupled to the temperature detection device and extending from the sandwiched assembly for monitoring a temperature at the temperature detection device.

2. The indirect-heat thermal processor according to claim 1, wherein the heating element is recessed in a first channel in the heat spreader.

3. The indirect-heat thermal processor according to claim 2, wherein the temperature detection device is recessed in a second channel in the heat spreader.

4. The indirect-heat thermal processor according to claim 1, wherein the ones of the heat transfer plate assemblies include a plurality of temperature detection devices, including the temperature detection device, the plurality of temperature detection devices being spaced apart along the heat spreader and spaced from the heating element.

5. The indirect-heat thermal processor according to claim 1, wherein edges of the ones of the heat transfer plate assemblies are sealed to inhibit ingress of fluid into the heat transfer plate assemblies.

6. The indirect-heat thermal processor according to claim 5, wherein the edges are sealed by welding edges of the covers.

7. The indirect-heat thermal processor according to claim 1, wherein the ones of the heat transfer plate assemblies include a stiffening bar extending along an edge of the sandwiched assembly.

8. The indirect-heat thermal processor according to claim 7, wherein the stiffening bar extends generally vertically in the housing.

9. The indirect-heat thermal processor according to claim 1, wherein the ones of the heat transfer plate assemblies include stiffening bars extending along opposite edges of the sandwiched assembly.

10. The indirect-heat thermal processor according to claim 9, wherein the stiffening bars extend generally vertically in the housing.

11. The indirect-heat thermal processor according to claim 1, wherein the heat spreader comprises a generally solid metal extending substantially the length of the sandwiched assembly.

12. The indirect-heat thermal processor according to claim 1, wherein the heat spreader comprises a copper plate including the first channel and the second channel therein.

13. A heat transfer plate assembly for use in an indirect-heat thermal processor for processing bulk solids, the heat transfer plate assembly comprising:

a heat spreader;

a heating element disposed adjacent the heat spreader;

a temperature detection device spaced from the heating element and disposed adjacent the heat spreader;

covers disposed on opposing sides of the heat spreader, the heating element, and the temperature detection device to provide a sandwiched assembly in which the heat spreader, the heating element, and the temperature detection device are sandwiched between the covers;

heating element couplings coupled to the heating element and extending from the sandwiched assembly for controlling the heating element; and a connector coupled to the temperature detection device and extending from the sandwiched assembly for monitoring a temperature at the temperature detection device.

14. The heat transfer plate assembly according to claim 13, wherein the heating element is recessed in a first channel in the heat spreader.

15. The heat transfer plate assembly according to claim 14, wherein the temperature detection device is recessed in a second channel in the heat spreader.

16. The heat transfer plate assembly according to claim 13, comprising a plurality of temperature detection devices, including the temperature detection device, the plurality of temperature detection devices being spaced apart along the heat spreader and spaced from the heating element.

17. The heat transfer plate assembly according to claim 13, wherein edges of the sandwiched assembly are sealed to inhibit ingress of fluid into the heat transfer plate assemblies.

18. The heat transfer plate assembly according to claim 17, wherein the edges are sealed by welding edges of the covers.

19. The heat transfer plate assembly according to claim 13, comprising a stiffening bar extending along an edge of the sandwiched assembly.

20. The heat transfer plate assembly according to claim 13, comprising stiffening bars extending along opposite edges of the sandwiched assembly.

21. The heat transfer plate assembly according to claim 13, wherein the heat spreader comprises a generally solid metal extending substantially the length of the sandwiched assembly.

22. The heat transfer plate assembly according to claim 13, wherein the heat spreader comprises a copper plate including the first channel and the second channel therein.

* * * * *